US012790109B2

(12) United States Patent
Jacobson

(10) Patent No.: US 12,790,109 B2
(45) Date of Patent: Nov. 10, 2026

(54) CARGO SHIPPING PLATFORM FOR LIGHTWEIGHT CARGO CONTAINERS

(71) Applicant: David A Jacobson, Rochester, MI (US)

(72) Inventor: David A Jacobson, Rochester, MI (US)

( * ) Notice: Subject to any disclaimer, the term of this patent is extended or adjusted under 35 U.S.C. 154(b) by 13 days.

(21) Appl. No.: 17/504,574

(22) Filed: Oct. 19, 2021

(65) Prior Publication Data

US 2023/0124598 A1 Apr. 20, 2023

(51) Int. Cl.

| | |
|---|---|
| ***B65D 88/12*** | (2006.01) |
| ***B65D 77/26*** | (2006.01) |
| ***B65D 88/58*** | (2006.01) |
| ***B65D 90/00*** | (2006.01) |
| ***B65D 90/08*** | (2006.01) |
| ***B65D 90/62*** | (2006.01) |

(52) U.S. Cl.

CPC ..... *B65D 88/127* (2013.01); *B65D 77/26* (2013.01); *B65D 88/121* (2013.01); *B65D 88/58* (2013.01); *B65D 90/006* (2013.01); *B65D 90/008* (2013.01); *B65D 90/08* (2013.01); *B65D 90/623* (2013.01); *B65D 90/0026* (2013.01); *B65D 2588/12* (2013.01); *B65D 2590/0066* (2013.01); *B65D 2590/54* (2013.01)

(58) Field of Classification Search

CPC ..... B65D 88/121; B65D 2588/12; B65D 88/005; B65D 88/127; B65D 88/58; B65D 90/08; B65D 90/0026; B65D 19/06; B65D 19/385; B65D 88/129; B65D 2519/00532; B65D 2519/00512; B65D 90/008; B65D 19/44; B65D 77/26; B65D 2519/0081; B65D 2519/00815; B65D 2519/0082; B65D 90/006; B65D 2590/0066; B65D 2590/54

See application file for complete search history.

(56) References Cited

U.S. PATENT DOCUMENTS 4,558,797 A * 12/1985 Mitchell ..... B65D 90/08 52/282.4
4,836,395 A * 6/1989 Goutille ..... B65D 88/121 220/4.28

(Continued)

FOREIGN PATENT DOCUMENTS

| | | |
|---|---|---|
| EP | 0090194 A1 | 10/1983 |
| EP | 0708732 A1 | 5/1996 |
| GB | 2349140 A | 10/2000 |

*Primary Examiner* — Nathan J Jenness
*Assistant Examiner* — Jennifer Castriotta

(57) ABSTRACT

The low-weight design, cargo shipping container as an alternative to the conventional steel container for transportation of e-commerce cargo is provided which uses light container modules enclosed within the cargo shipping container. The present invention is made of four corner upright members and a plurality of horizontal long and short members connected to form a rectangular cage like platform to accommodate and enclose any light weight container module. The shipping container further includes a pair of central upright members to provide additional support to the platform and a plurality of side gate arms configured between top ends of the corner upright and bottom ends of the central upright member at an angle of 45 degree to form a zigzag wall at the sides of the platform to prevent displacement of the container module during shipping.

5 Claims, 5 Drawing Sheets

(56) References Cited

U.S. PATENT DOCUMENTS

| | | | | | |
|---|---|---|---|---|---|
| 4,875,814 | A * | 10/1989 | Weller | B65D 88/123 | 410/121 |
| 4,944,421 | A * | 7/1990 | Yurgevich | B65D 90/00 | 220/DIG. 29 |
| 5,275,301 | A * | 1/1994 | Clive-Smith | B65D 88/129 | 220/6 |
| 5,494,167 | A * | 2/1996 | Hasegawa | B65D 7/24 | 108/56.1 |
| 5,823,375 | A | 10/1998 | Nessfield | | |
| 6,010,021 | A * | 1/2000 | Zuidam | B65D 77/0453 | 206/499 |
| 7,011,223 | B1 * | 3/2006 | Grigsby, Sr. | B65D 19/385 | 108/56.1 |
| 7,975,865 | B2 * | 7/2011 | Marcel | B65D 90/008 | 220/678 |
| 8,925,470 | B2 * | 1/2015 | Hart | B65D 71/0092 | 108/55.1 |
| 9,790,022 | B2 | 10/2017 | Sheesley et al. | | |
| 2016/0052670 | A1 * | 2/2016 | Skeid | B65D 19/385 | 108/52.1 |
| 2017/0131015 | A1 | 5/2017 | Farraar | | |

* cited by examiner

CARGO SHIPPING PLATFORM FOR LIGHTWEIGHT CARGO CONTAINERS

FIELD OF INVENTION

The invention relates to the field of cargo shipping or transportation container. More particularly, it provides a container capable for enclosure of two light-weight cargo containers that works as an alternative to traditional plated steel containers while reducing overall weight resulting in reduction of overall fuel consumption as well as CO2 emissions during transportation.

BACKGROUND

The shipping industry began using steel containers about six decades ago, as result of the need for a stronger carrier box for goods and products being shipped on ocean going ships to the global marketplace. Over the course of the last six decades, the use of steel continues to be the standard in the shipping industry with an estimated 17 million intermodal containers around the world. Prior to steel containers, large wooden boxes were used for shipping products. This was difficult since everything had to be counted and loaded by hand; the wooden boxes could not handle the loads; hoisting them in the air was a challenge; and nothing could be done without a strong and dedicated group of employees to handle the tasks.

Although, wooden pallets are used inside steel containers, they are an environmental hazard requiring the destruction of millions of acres of forest annually and requiring the injection of carcinogens for insect and fire protection. Therefore, a new steel pallet is needed that removes those negatives yet provide years of reusable service to the shipping companies. Best of all they can be stacked two high in light weight containers and be secured inside the container making movement of the cargo impossible and in turn any possibility of the cargo breaking through the side walls of the lightweight containers.

The popularity of steel containers grew because they were able to handle heavy cargo; provided security during shipping; could avoid rats and pest infestations; and were easy to handle from loading to unloading. In 1956, the first container ship, an old oil tanker, was converted to hold 58 containers moving from Newark, New Jersey to Houston, Texas. Since that time container ships have continued to grow in size and capacity, and today the largest ships can hold 12,000 40' containers.

While it is often difficult to change things that have become standardized within an industry, the fact is, that an alternative to steel containers is needed for other reasons in addition to the shortages now being experienced. One of the reasons the shipping companies embraced steel containers was their ability to carry cargo without the danger of the cargo breaking through the steel sides. While this is still a consideration when hauling very heavy cargo, the fact is that the average e-Commerce product weigh an average of only 8 pounds. This lighter weight cargo does not present the same problem as a steel container full of car batteries.

There were numerous inventions which talk about providing light weight solution for shipping containers. For example, U.S. Pat. No. 8,672,137B2 discusses about lightweight, thermally insulating collapsible shipping container made up of plurality of surfaces including the base, four walls and a top panel each being made of light weight core. These shipping containers have openable and adjustable panel walls to suit the items being shipped. In the structure, metal mesh can be inserted into the core to resist piercing of the substance and also the walls are held together with clasps. Upon delivery and unloading, the walls and top of the container can be disassembled and stacked on the dunnage base to reduce the volume of the container for storage or further shipment.

Moreover, US 2014190976A1 is directed at providing a cargo container that is light, strong, durable and weather/dust particle barrier and controls the climate inside the container in order to protect the integrity of the cargo. Furthermore, U.S. Pat. No. 7,963,397B2 talks about light weight shipping containers which can be dissembled and assembled. It has a light, strong, fire-resistant material protecting the integrity of the shipping containers.

However, none of the above-mentioned inventions talk about a container made of a steel frame or container made according to the regulation of ISO and capable of enclosing light weight containers to form a container for transportation of e-commerce and other similar cargo, and therefore becoming an alternative to heavy steel plated containers. Further, there exists a need of standard sized container which can be divided into two equal sized chambers to accommodate and enclose two separate small container modules to provide the shipping companies the same functionality as a traditional steel container but with reduced weight and better accessibility. Moreover, there is a need for an invention which provides a cost-effective solution to conventional steel cargo shipping without having to use any extra equipment at the shipping site. Two separate light weight containers allow consolidation of the cargo by shipper, and also allows each light weight container to be moved to a different delivery destination without unloading an entire 40' container. The 20' light weight containers are also a desired product for businesses operating in the moving and storage industry, and as such can be used just once to move cargo on a container ship and then sold for at cost upon delivery to the U.S. This savings reduces operating costs for the shipping companies, and allows the possibility of reduced overall shipping costs for the manufacturers shipping their goods to the U.S.

SUMMARY

The present disclosure overcomes one or more shortcomings of the prior art and provide additional advantages discussed throughout the present disclosure. Additional features and advantages are realized through the techniques of the present disclosure. Other embodiments and aspects of the disclosure are described in detail herein and are considered a part of the claimed disclosure.

The embodiment of present invention provides an enclosure or specifically a container which is capable of enclosing light-weight cargo containers for shipment of e-commerce or any other cargo. According to one embodiment, the present invention provides a light-weight solution or an alternative to the existing steel containers which are being used in ocean-going shipping business. According to one embodiment, the container of present invention is an enclosure for removable placement of light-weight container modules of present invention that may store and ship the e-commerce or any other cargo in ocean going trips.

According to one embodiment, though the lightweight container modules on their own do not meet ISO regulations, the present enclosure container meets with all the strict regulations established by the ISO making the shipping containers and the set of light-weight container modules inside, suitable for ship, rail and truck transport. According to one embodiment, weight reduction because of the use of present enclosure container with a low-weight container module reduces ultimate consumption of fuel being used for shipping which further reduces CO2 emissions. According to present embodiment, the present enclosure container or cargo shipping container is of a standard size of 40' feet divided into two equal sized chambers to accommodate and enclose two separate lightweight container modules to provide the shipping companies same functionality as traditional steel container but with reduced weight and better accessibility. According to one embodiment, use of two separate container modules enclosed within the present cargo shipping container makes it more accessible by the shipping companies as both the container modules includes their own opening and/or door making it easier for shipping companies or a customs-authorities to access the cargo placed within them as compared to the conventional 40' steel container with a single door opening. This two opening each in two 20' container module makes it more practical and easier for port authorities or shipping company employees to check the load if needed or requested.

Possibly seeming to be unrelated to the patent application at hand, the fact is that the entire solution requires the unified use of the steel pallets, inside lightweight shipping containers that are then packed within the Cargo Shipping Container for lightweight cargo containers. The benefits of lighter weight containers include a reduction in fuel required, which is important since 50%-60% of total ship operating costs are represented by fuel consumption. Research shows that a 20% decrease in container weight would save the global fleet $28 billion in fuel cost alone over the next 15 years. More importantly, the reduction in weight would provide up to 30% decrease in the carbon emissions of the ships using the lighter containers.

But, the Cargo Shipping Container of present invention opens up new opportunities for intermodal rail transportation by allowing two of the containers on one well rail car. These well rail cars are designed with a lowered shipping deck that rides much closer to the rails. By lowering the deck, it allows two 9'6" high cargo shipping containers to be double stacked on the well car, thus essentially cutting costs in half for the movement of the cargo inside. And it is important to note that the maximum load limit for intermodal rail is 42,250 total pounds including the container and cargo. The current steel containers weigh 10,000 pounds empty, and so only 32,250 pounds of cargo can be loaded inside. The two lightweight containers and the cargo shipping container weigh a combined 6,900 pounds to allow 35,350 pounds of cargo. This means that light weight containers inside the cargo shipping container can carry 3,100 pounds more cargo than a standard 40' container. This means lightweight containers inside cargo shipping containers can carry 6.5% more cargo then standard 40' containers when shipped on intermodal rail.

According to present embodiment, the cargo shipping container of present invention is a hinged and gate opening system to allow light weight container modules to be lifted into the cargo shipping container by a common forklift available at all ports. The side openable hinged and gate system uses diagonal steel gate arms hinged on both sides of the container to secure the lightweight containers once placed inside. The side hinged and gate structure or arm of present container is provided to enclose and accommodate lightweight cargo container modules which serves as a low-weight alternative to the conventional plated steel containers weighing nearly 10,000 pounds when empty. According to one embodiment, the cargo shipping container of present invention is made of four corner uprights connected with plurality of horizontal long members that forms the length of the cargo shipping container and plurality of short members connected perpendicular to the long members connecting at the corners of the uprights to form a width of the present cargo shipping container, where each of four top corner nodes have standard connection caps recognized as the standard in the container manufacturing industry for lifting containers with cranes. According to one embodiment, each four bottom corner have a standard stacking cap which connects corner uprights, long members and short members.

According to one embodiment, all these members are connected using the connection means such as nut-bolt assembly or directly welded together within the connection corner cap to provide extreme strength to meet or exceed ISO regulations. The structure of present cargo shipping container further includes a set of central uprights configured to further support the structure as well as to divide the whole length of cargo shipping container into two equal parts to form two sections such that each section may enclose at least one lightweight cargo container module of 20' feet. Each of the central uprights is further capable of being engaged and disengaged from the cargo shipping container during the placement and removal of the lightweight cargo container module from the cargo shipping container.

According to one embodiment, the cargo shipping container further includes two gate arms on each side, hinged at the top corner and angled downwards to the bottom of the center upright to secure the lightweight containers within the cargo shipping container by closing said gate arm. According to one embodiment, the hinged connection of each gate arm allows easy opening and closing of the gate arm to allow easy placement and removal of the cargo container within the container. According to one embodiment, the hinged gate arms at each side of the cargo shipping container of present invention is provided to prevent accidental removal of the cargo container module from the cargo shipping container during the transportation or shipping over the ship, train or any other vehicle. According to one embodiment, all these members are fastened together or connected within the standard corner caps to form the rectangular structure of the cargo shipping container wherein each member of the container is permanently fastened except the central upright members and hinged side gate arms that forms a side wall which encloses and holds the cargo container module of present within the cargo shipping container of present invention. The gate arms weight 80 pounds each, and so a steel rolling wheels has been added to the bottom of each gate so that opening and closing is made easy and convenient for port workers.

According to one embodiment, the cargo shipping container of present invention includes a hinged member configured at an angle made between the top end of the corner upright and the horizontal long member for gate arm to get hinged from one end angled downward such that the opposite end of the gate arm may align the bottom end of the central upright when closed to easily lock the gate arm at the central bottom node forming a side wall at one side of the half portion of present cargo shipping container.

According to one embodiment, the process of placement and enclosure of light weight cargo container modules into present cargo shipping container includes steps of disengaging or unlocking the bottom end of the hinged gate arms of any one side of the cargo shipping container and opening said arms, removing the central upright of the same side creating a complete opening for sliding or placing two cargo container modules within the cargo shipping container using any cargo lift or fork lift. Once the lightweight cargo container module is placed within the cargo shipping container, the central upright is again placed in its position and fastened while the hinged gate arms are closed and locked at the bottom node at center of the module to enclose the cargo container module within the cargo shipping container which forms a complete cargo container of 40' made of two 20' container module which is almost half the weight of conventional steel containers.

BRIEF DESCRIPTION OF DRAWINGS

The foregoing summary, as well as the following detailed description of the invention is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF INVENTION

Figure 1:
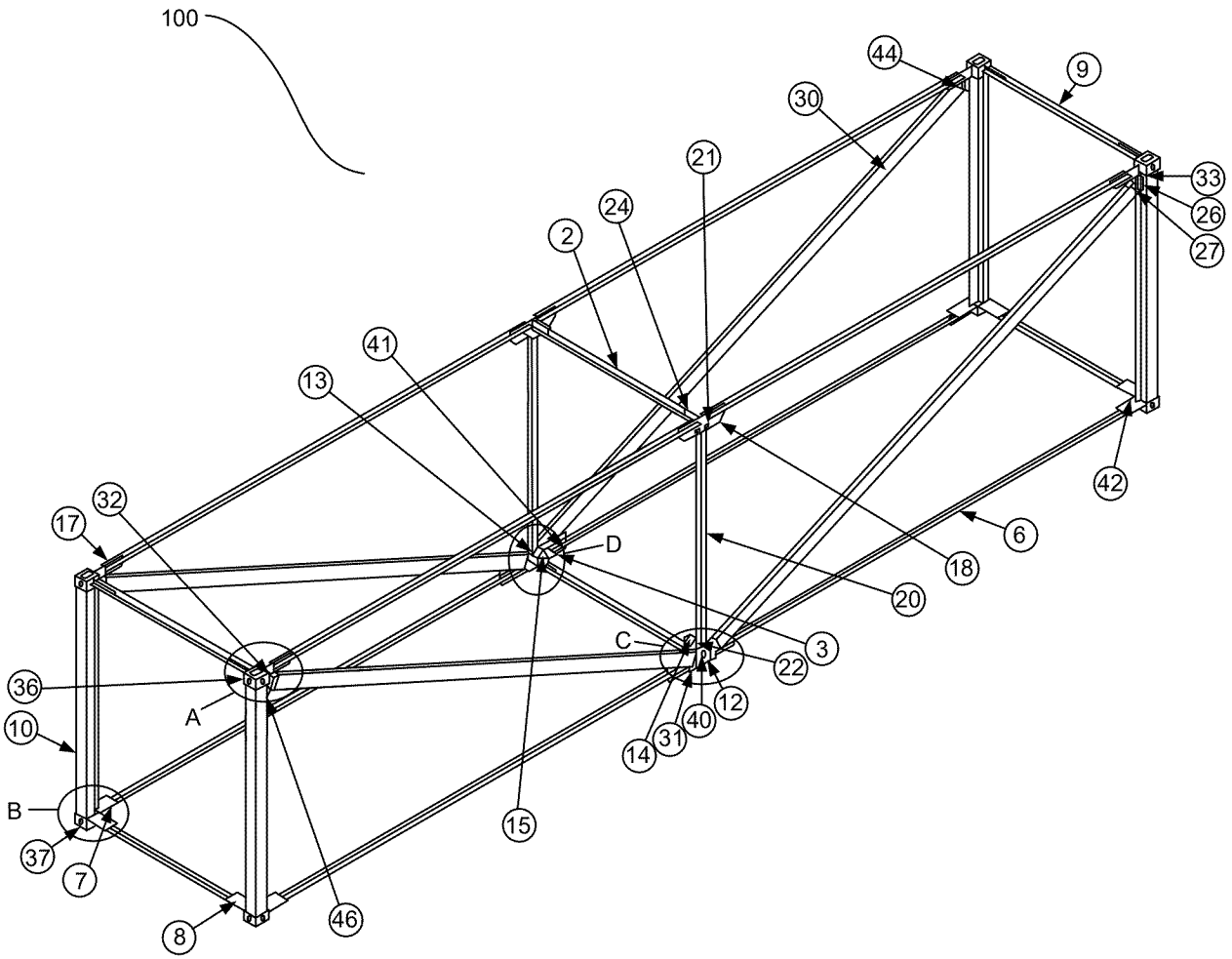
FIG. 1 illustrates an isometric view of a cargo shipping container of present invention.

The present invention overcomes the aforesaid drawbacks of the above, and other objects, features and advantages of the present invention will now be described in greater detail. Also, the following descriptions include various specific details and are to be regarded as merely exemplary. Accordingly, those of ordinary skill in the art will recognize that: without departing from the scope and spirit of the present disclosure and its various embodiments there may be any number of changes and modifications described herein.

The invention provides a cargo shipping container for light-weight cargo container modules that together works as a low-weight alternative to the conventional beefy steel containers currently being used in shipping business for transportation via ocean, rail or trucks. According to one embodiment, this low-weight alternative is provided to decrease the overall weight of the shipment while keeping the space for cargo, size and all the other features same as the conventional shipping containers. This decrease in weight, according to research, will also decrease the fuel consumption during transportation which will further result in decrease in CO2 emission and will also help the global shipping companies to achieve the objective of 0% carbon emission by 2050. Moreover, it will save hundreds of billions used for fuel by these shipping companies.

Instead of complete container made of a plated steel, the invention provides a shipping container made in the shape of rectangular frame or cage according to standards and regulations established by the ISO which encloses any low-weight container modules made of any other material than steel or made with steel but with lower gauge compared to conventional containers, carbon fiber or any other lighter weight material. The lower weight of these materials compared to the conventional containers weighing approximately 10,000 pounds empty, ultimately reduces final weight of the loaded cargo shipping container along with shipping containers to half of the weight of conventional shipping containers while keeping the same functionality or with additional functionality. Further, the lighter weight of the light container modules results in easier movement whenever needed during the journey from manufacturer to the last mile delivery location. Also, lighter weight reduces the need of heavy-duty forklifts and other equipment as well as makes it easier and less labor intensive to move containers onto trucks, railroad cars, or into warehouse thus leading to reduced labor and equipment costs.

According to present embodiment, the invention provides a cargo shipping container for e-commerce cargo, where the container is of the size same to the standard container size of 40' feet, also with standard lifting corner top or corner cap to allow easy lifting of present cargo shipping container of present invention using conventional cranes available at ports. Further, the cargo shipping container of present invention includes a standard stacking corner bottom caps at each bottom corner of said cargo shipping container to provide stackability to said container so that container may get stacked up to 8 high to meet ISO stacking standards.

According to one embodiment, the same size of present cargo shipping container with standard container size makes it capable of being used as an alternative to the conventional steel containers without any limitations, thus it does not require any additional special equipment or machines and may be handled using conventional handling equipment and machines only. According to one embodiment, the cargo shipping container of present invention accommodates two 20' feet light weight container modules of present invention, where each container module has its own opening door allowing easy accessibility for checking and inspection purpose as every 20' feet distance have its own opening compared to single opening in 40' feet conventional container. Thus, the present cargo shipping container along with the container modules provide more accessibility and ease of handling and management of cargo during transportation or during storage.

FIG. 1 illustrates isometric view of one exemplary embodiment of cargo shipping container 100 of present invention. According to present embodiment, the cargo shipping container 100 is made in the shape of rectangle to accommodate and enclose the low-weight containers, wherein the container 100 is made of: a plurality of corner uprights 10 configured at each corner of the present cargo shipping container 100; a plurality of horizontal long members 6 fastened lengthwise at each end of the plurality of corner uprights 10 forming upper node A and lower node B, where the upper horizontal long members 6 are fastened with the upper ends of the corner uprights 10 at node A while the lower horizontal long members 6 are fastened with bottom ends of the corner uprights 10 at node B from one end of the horizontal long members 6. According to one embodiment, the opposite ends of all said horizontal long members 6 are fastened at respective end of a central upright members 20.

According to present embodiment, the central upright members 20 of the shipping container 100 is provided for additional support and durability to the shipping container 100 during transportation as well as to create a safety wall at the sides to prevent accidental removal of the container module from the shipping container during ocean-trip or transportation, where the central upright members 20 are removably configured at a bottom node D to allow it to be removed during placement and removal of the cargo container module. According to one embodiment, the container 100 further includes a plurality of horizontal short members 9 right angled with the horizontal long members 6 and connected horizontally with the corner uprights 10 to form a width of the shipping container 100.

According to one embodiment, at least two side gate arms 30 are provided at each long side of the cargo container of present invention, wherein each side gate arm 30 is hinged at the top corner made between the corner uprights 10 and the horizontal long members 6 from one end. Further, each of the side gate arm is angled downward towards the bottom of the center upright 20 to releasably fasten the opposite end at the bottom node C of the center upright 20 and to allow easy opening or closing of each side gate arm during placement and removal of the cargo container module within the container 100.

According to one embodiment, each of the plurality of the hinged side gate arms 30 at each side of the cargo shipping container 100 of present invention is provided to prevent accidental removal of the cargo container module from the cargo shipping container 100 during the transportation or shipping over the ship, train or any other vehicle. According to one embodiment, the side gate arm 30 connects at the node A using hinge connection from one end while the opposite end connects at the bottom of the central upright member 20 of respective side forming a zigzag shaped protective wall or gate when closed and fastened at the node C.

According to one embodiment, the cargo shipping container 100 of present invention further includes a pair of central horizontal short member 2 configured to connect and support respective top and bottom ends of both the central upright members 20. According to one embodiment, the central top junction or node where the top end of the central uprights 20, horizontal long member 6 and horizontal short member 2 fastens together further includes a connection plate 18 which allows connection of horizontal long members 6 with the central uprights 20, a perpendicular extending plate 24 from the connection plate 18 to allow the horizontal short members 2 to get screwed using nut and bolt assembly. According to one embodiment, the central top junction further includes a locking plates 21 extending out of the connection plate 18 to lock the central upright members 20 once configured.

Figure 2:
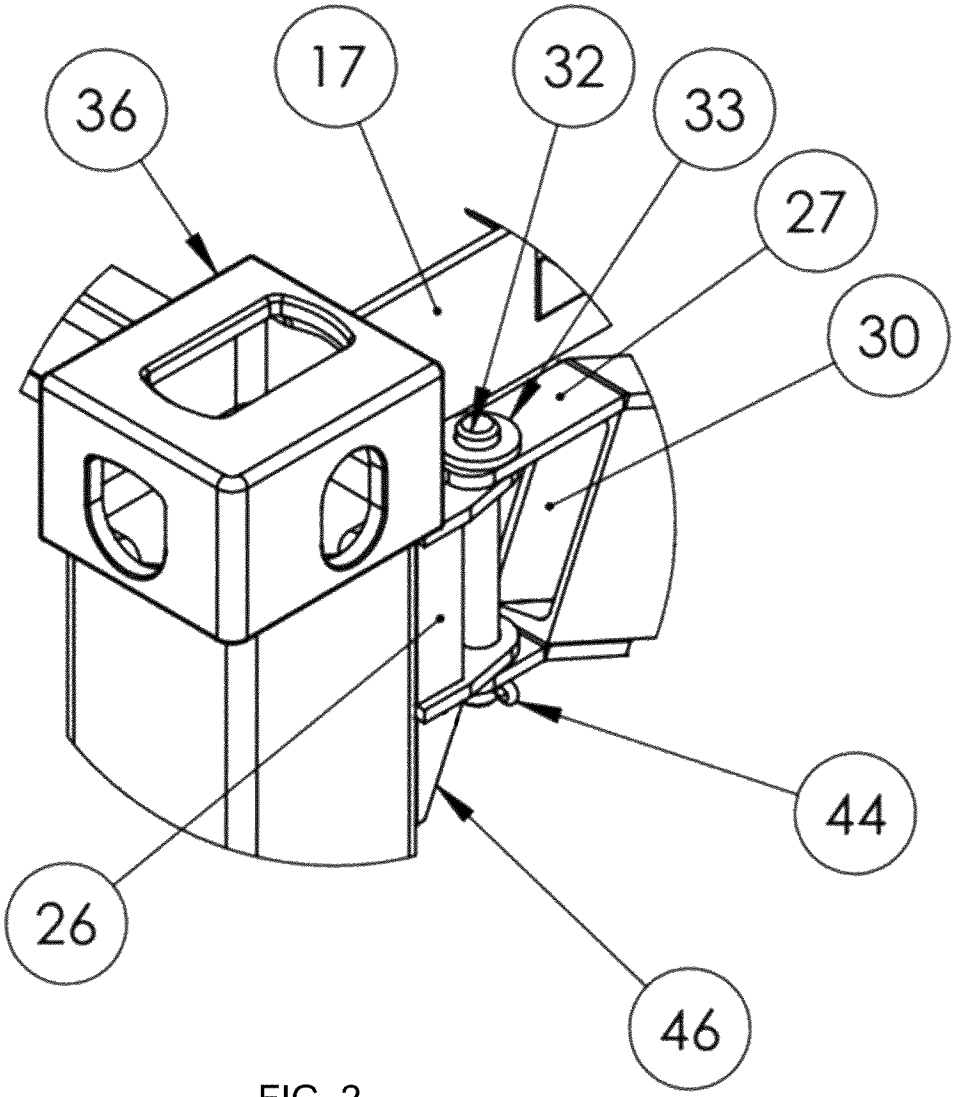
FIG. 2 shows detailed view of node A of the cargo shipping container of present invention shown in FIG. 1.

FIG. 2 shows detailed view of a node A where the upper end of the corner uprights is provided with a standard connection caps 36 recognized as the standard for lifting containers with cranes; Other members of the container connecting at the junction forming a node A. According to one embodiment, the upper end of the corner upright 10, at least one end of longitudinal long member 17 and at least one end of horizontal short member 9 fastens/welded together with each other and with the standard connection cap 36 forming a junction point called node A. According to one embodiment, the node A further shows hinged connection of the side gate arm 30 fastened at the corner made between the corner upright 10 and the longitudinal long member 17 and configured angling downward so that the opposite end of the side gate arm may extend and align with the bottom end of the central upright 20.

According to one embodiment, the fastening mechanism of the side gate arm 30 at the corner includes a connection end of the angled side gate arm 30 having an extended horizontal plate 27 having an aperture to allow passing of the bolt member 32 through the aperture to hingedly couple the side gate arm 30. According to one embodiment, a U-shaped member 26 permanently fastened or welded at the wall of the corner upright 10, where both the arms of the U-shaped member 26 further includes holes aligned to each other which facilitates further aligning of the aperture of the extended horizontal plate 27 so that the bolt 32 may pass through both the arms of the U-shaped member 26 and the extended horizontal plate 27 and hingedly fasten the angled side gate arm 30.

According to one embodiment, the U-shaped member 26 of the fastening mechanism is further provided support using the support member 46. According to one embodiment, a locking pin 44 is coupled at the end of the bolt member 32 after passing it through the aligned apertures to lock and hold the side gate arm 30. According to one embodiment, the bolt member 32 is further passed through the washer 33 for additional grip.

Figure 3:
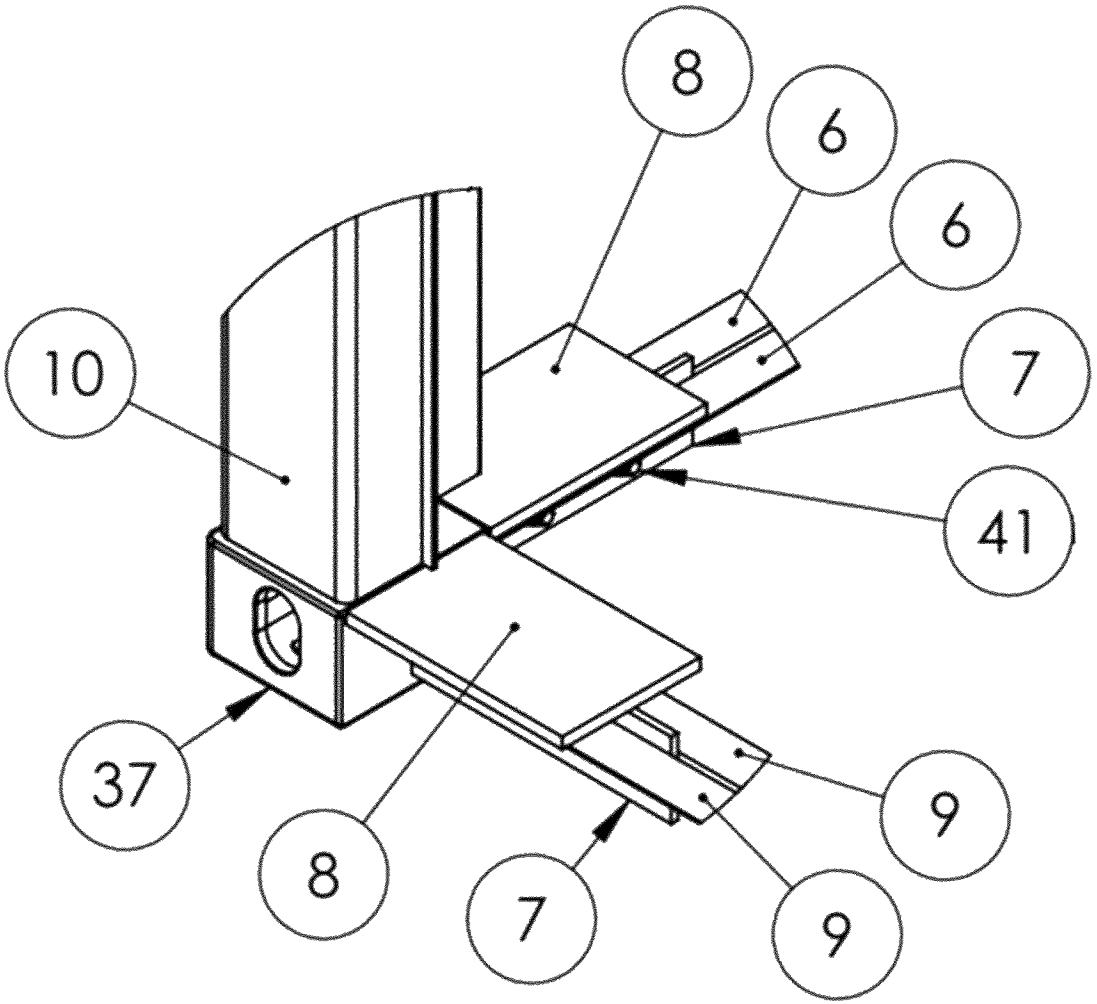
FIG. 3 shows detailed view of a node B of the cargo shipping container of present invention shown in FIG. 1.

Now, FIG. 3 shows a detailed view of Node B where the bottom end of the corner upright 10, bottom longitudinal long members 5 and horizontal short members 9 are fastened or permanently welded together as well as with the standard stacking cap 37 configured at each bottom end of the container to allow easy stacking over other cargo container. According to one embodiment, a support frames 8 mounted over a vertical support member 7 which is fastened with the longitudinal long member 5 and horizontal short member 9 using the nut—bolt assembly 41, wherein the support frames 8 are configured to support the cargo container module when placed within the present cargo shipping container 100.

Figure 4:
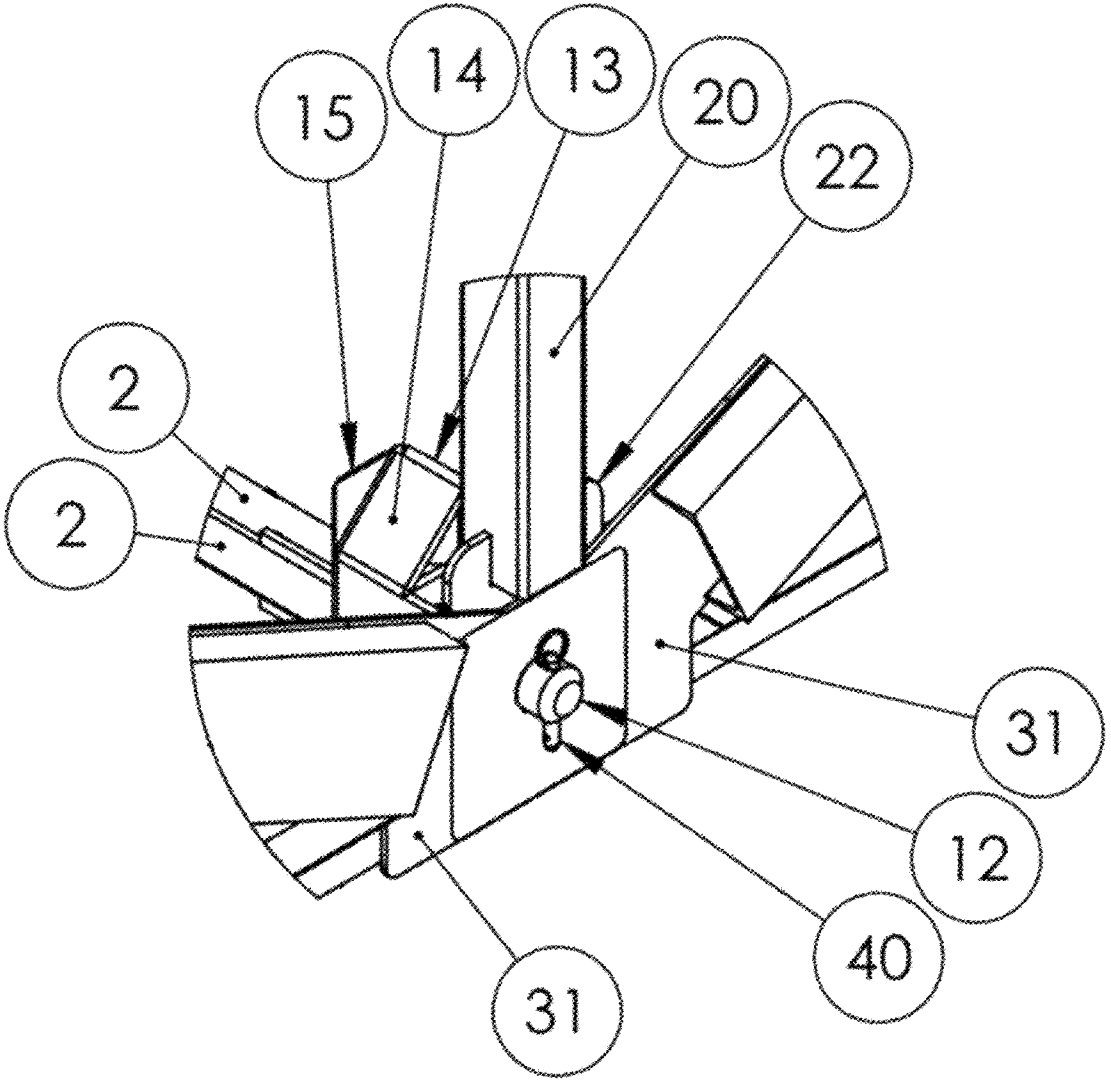
FIG. 4 shows detailed view of a node C of the cargo shipping container of present invention shown in FIG. 1.

FIG. 4 of present invention shows front end of the central junction point disclosed as a node C, where the bottom end of the central upright 20 fastens or connects with both the side gate arms 30 of one respective side, both the bottom longitudinal long members 5 and the central horizontal short member 2 forming a junction or node C. According to present embodiment, both the side gate arms 30 further includes an extended plates 31 at the ends of each side gate arm 30, where the extended plates 31 further includes an apertures which aligns with each other when the side gate arms 30 are closed so that the fastening member 12 may easily pass through the apertures to extend out and locked using the locking pin 40.

Figure 5:
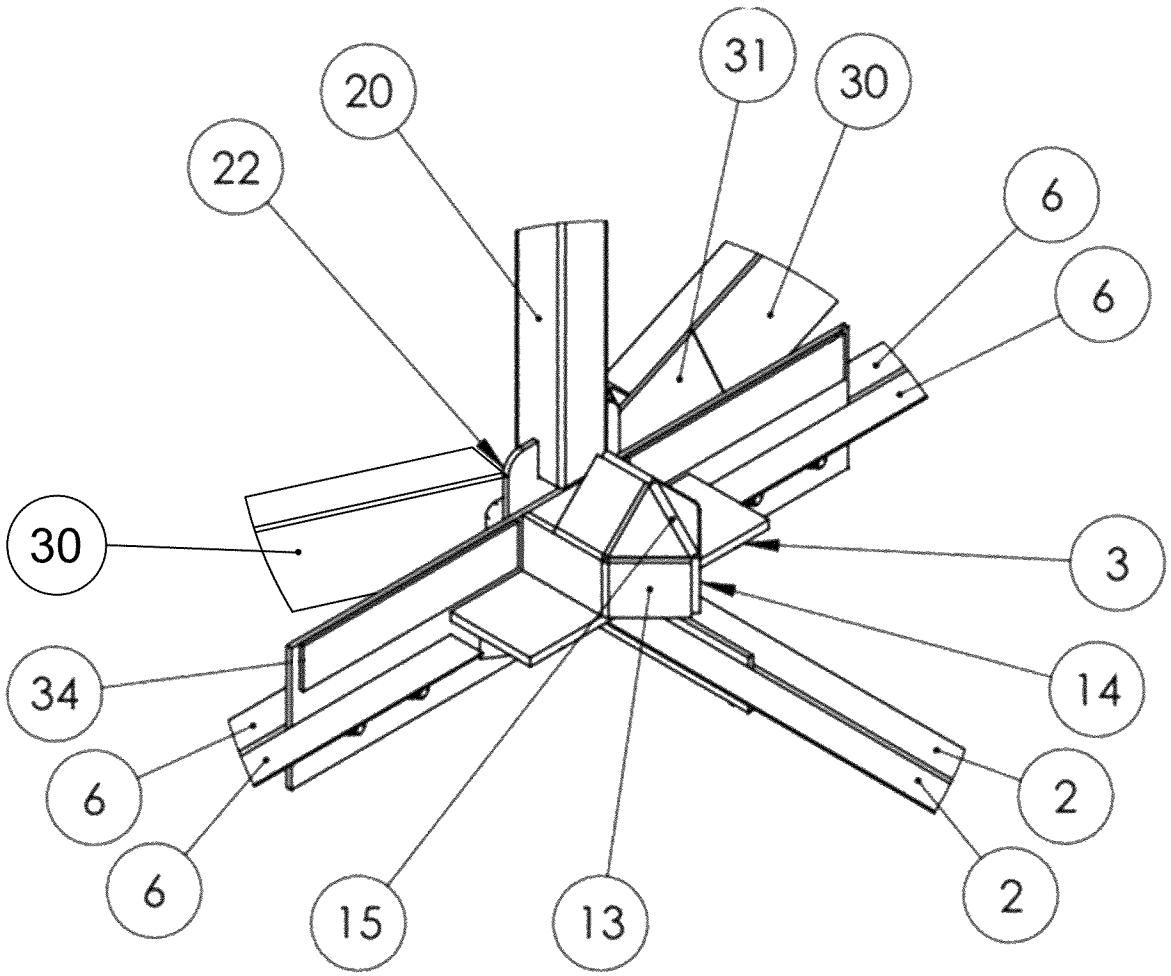
FIG. 5 shows detailed view of a node D of the cargo shipping container of present invention shown in FIG. 1.

FIG. 5 shows detailed view of an opposite side of the node C which is explained herewith as a junction or node D for easy understanding. According to one embodiment, the inner junction D as shown in FIG. 5 of present invention includes a triangular shaped design with plurality or sloping walls which is provided for easy configuration or placement of cargo container modules within the present container. According to present embodiment, the central upright member 20 is removable to allow easy removal during placement of the cargo container module. The central upright 20 is configured over the support member 22 and locked from the top end to prevent displacement during transportation.

According to one embodiment, all the junctions and/or nodes including node D includes a supporting plate 3 that is provided to place and hold or for additional support to the cargo container module when placed inside the present container. A plurality of curved walls (13, 14 and 15) forming slopes facing the sides where the cargo container module gets placed to allow cargo container modules to easily slide down from said curved walls (13, 14 and 15) and gets placed over the support frame 3.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. A cargo shipping platform for transporting a first lightweight cargo container and a second lightweight cargo container, wherein the first lightweight cargo container and the second lightweight cargo container are contained within the platform, the platform comprising;

a base frame including four corner uprights comprising a first corner upright, a second corner upright, a third corner upright and a fourth corner upright, and a pair of central uprights comprising a first central upright and a second central upright, and horizontal long member segments and horizontal short member segments arranged as follows with respect to the uprights:

a first horizontal long member segment extending from a top end of the first corner upright to a top end of the first central upright, a second horizontal long member segment extending from a top end of the first central upright to a top end of the third corner upright, a third horizontal long member segment extending from a bottom end of the first corner upright to a bottom end of the first central upright, a fourth horizontal long member segment extending from a bottom end of the first central upright to a bottom end of the third corner upright, a fifth horizontal long member segment extending from a top end of the second corner upright to a top end of the second central upright, a sixth horizontal long member segment extending from a top end of the second central upright to a top end of the fourth corner upright, a seventh horizontal long member segment extending from a bottom end of the second corner upright to a bottom end of the second central upright, an eighth horizontal long member segment extending from a bottom end of the second central upright to a bottom end of the fourth corner upright, a first horizontal short member extending from a top end of the first corner upright to a top end of the second corner upright, a second horizontal short member extending from a top end of the first central upright to a top end of the second central upright, a third horizontal short member extending from a top end of the third corner upright to the top end of the fourth corner upright, a fourth horizontal short member extending from a bottom end of the first corner upright to a bottom end of the second corner upright, a fifth horizontal short member extending from a bottom end of the first central upright to a bottom end of the second central upright, a sixth horizontal short member extending from a bottom end of the third corner upright to a bottom end of the fourth corner upright;

a first side gate arm hinged at the top end of the second corner upright and angled downwards towards the bottom end of the second central upright;

a second side gate arm hinged at the top end of the fourth corner upright and angled downwards towards the bottom end of the second central upright;

wherein each of the first and second side gate arms is pivotable to open and close;

wherein a node is provided adjacent the bottom end of the second central upright, the node being a wedge-shaped structure having a plurality of angled walls converging toward an interior region of the platform; and wherein the platform, so constructed, enables:

a) opening the side gate arms, and disengagement of the second central upright from the remainder of the base frame without removing the node, to thereby produce first and second full-height lateral openings in a side of the platform for side loading of the first and second lightweight cargo containers, wherein the first and second lightweight cargo containers are enabled to slide into, and be centered and aligned into, the platform during loading by contact with the angled walls of the node; and b) re-engagement of the second central upright and closing of the side gate arms, to thereby close the full-height lateral openings in the side of the platform once the first and second lightweight cargo containers have been loaded.

2. The cargo shipping platform of claim 1, wherein a downward angle of each side gate arm is 45 degrees.

3. The cargo shipping platform of claim 1, wherein the platform further includes a third side gate arm and a fourth side gate arm; wherein the first and second side gate arms are located on one side of the platform, and the third and fourth side gate arms are located on an opposite side of the platform, thus enabling cargo containers to be side loaded into the platform from either side of the platform.

4. The cargo shipping platform of claim 1, wherein the platform size conforms to ISO regulations.

5. A method of using the cargo shipping platform of claim 1, the method, at a time of loading of the first and second lightweight cargo containers, comprising steps of:

i) opening each of the first side gate arm and the second side gate arm;

ii) removing the second central upright;

iii) sliding the first and second lightweight cargo containers into the respective first and second full-height lateral openings;

iv) replacing the second central upright; and v) closing each of the first and second side gate arms.

* * * * *